US008240587B2

(12) United States Patent
Gunnarsson et al.

(10) Patent No.: US 8,240,587 B2
(45) Date of Patent: Aug. 14, 2012

(54) GYRATORY CRUSHER

(75) Inventors: Johan Gunnarsson, Sövde (SE); Niklas Åberg, Södra Sandby (SE)

(73) Assignee: Sandvik Intellectual Property AB, Sandviken (SE)

( * ) Notice: Subject to any disclaimer, the term of this patent is extended or adjusted under 35 U.S.C. 154(b) by 120 days.

(21) Appl. No.: 12/801,966

(22) Filed: Jul. 6, 2010

(65) Prior Publication Data

US 2011/0006143 A1 Jan. 13, 2011

(30) Foreign Application Priority Data

Jul. 7, 2009 (SE) ..... 0950537

(51) Int. Cl.
*B02C 2/04* (2006.01)

(52) U.S. Cl. ..... 241/216

(58) Field of Classification Search ..... 241/207–216
See application file for complete search history.

(56) References Cited

U.S. PATENT DOCUMENTS

| | | | | |
|---|---|---|---|---|
| 2,579,516 | A | 12/1951 | Roubal | |
| 3,891,153 | A | 6/1975 | Decker et al. | |
| 4,232,833 | A * | 11/1980 | Werginz | 241/37 |
| 2009/0008486 | A1 | 1/2009 | Torres et al. | |

FOREIGN PATENT DOCUMENTS

| | | |
|---|---|---|
| GB | 832473 | 4/1960 |
| GB | 1 397 701 | 6/1975 |
| WO | 2008/103096 | 8/2008 |

OTHER PUBLICATIONS

International Search Report mailed Oct. 5, 2010 issued in PCT Application No. PCT/SE2010/050707.

* cited by examiner

*Primary Examiner* — Mark Rosenbaum
(74) *Attorney, Agent, or Firm* — Morgan, Lewis & Bockius LLP

(57) ABSTRACT

A gyratory crusher includes a crushing head, which is arranged rotatably on a substantially vertical shaft and on which a first crushing shell is mounted, and a frame, on which a second crushing shell is mounted, which second crushing shell, together with the first crushing shell, delimits a crushing gap. A supporting piston is arranged inside a cavity of the shaft, which supporting piston is displaceable in the vertical direction in order to adjust the width of the crushing gap. An eccentric is, by means of at least one radial bearing, arranged rotatably about the shaft. The gyratory crusher has an oil line, arranged in the cavity and extending through a piston plate included in the supporting piston, for supplying lubricating oil to a lubricating oil chamber configured at least partially in the cavity above the piston plate, the lubricating oil chamber being connected to the radial bearing by a duct arranged in the shaft.

25 Claims, 4 Drawing Sheets

GYRATORY CRUSHER

CROSS-REFERENCE TO PRIOR APPLICATION

This application claims priority to Sweden Application No. 0950537-1 filed Jul. 7, 2009, which is incorporated by reference herein.

FIELD OF THE INVENTION

The present invention relates to a gyratory crusher, comprising a crushing head, which is arranged rotatably about a substantially vertical shaft and on which a first crushing shell is mounted; a frame, on which a second crushing shell is mounted, which second crushing shell, together with the first crushing shell, delimits a crushing gap; a supporting piston, which is arranged inside a cavity of the shaft and which supports the crushing head and is displaceable in the vertical direction in order to adjust the width of the crushing gap; an eccentric, which by means of at least one radial bearing is arranged rotatably about the shaft; and a driving device, which is arranged to rotate the eccentric in order to cause the crushing head, which is arranged rotatably on the eccentric, to execute a gyratory pendulum movement for crushing of material introduced into the crushing gap.

BACKGROUND OF THE INVENTION

A gyratory crusher of the above-stated kind can be used for crushing, for example, ore and rock material into smaller size. U.S. Pat. No. 3,891,153 describes a gyratory crusher having a height-adjustable inner shell.

The above-described crusher has the drawback that the integral radial bearing surfaces are subjected to high wear and tear. Furthermore, the capacity of the crusher is limited, since the radial bearing surfaces can only handle loads up to a certain level. Moreover, a great deal of heat is generated in the radial bearing surfaces.

SUMMARY

One object of the present invention is to provide a gyratory crusher in which the above-stated drawbacks have been considerably reduced, or wholly eliminated.

This object is achieved with a gyratory crusher of the kind stated in the introduction, which is provided with an oil line, arranged in the cavity and extending through a piston plate comprised in the supporting piston, for supplying lubricating oil to a lubricating oil chamber configured at least partially in the cavity above the piston plate, the lubricating oil chamber being connected to the radial bearing by a duct arranged in the shaft.

An advantage with this gyratory crusher is that mechanical wear and tear which occurs in the radial bearings of the crusher during operation of the crusher is considerably reduced, since lubricating oil can be reliably supplied. The costs of maintenance of the crusher are thus substantially reduced. Moreover, the capacity of the crusher increases, since the supplied lubricating oil cools the radial bearings.

Preferably, the radial bearings comprise at least one bearing bush, formed of bearing metal, to produce an especially robust radial bearing.

The width of the crushing gap is preferably adjustable by regulation of the quantity of oil in a high-pressure oil chamber configured at least partially in the cavity below the piston plate.

The oil line preferably accommodates a measuring device for measuring the position of the first crushing shell in the vertical direction in relation to the position of the second crushing shell in the vertical direction. An advantage with this is that a more accurate, and expediently automatic regulation of the width of the crushing gap is enabled.

In one embodiment, the oil line comprises a telescoping tube having a first tube part and a second tube part. An advantage with this embodiment is that an oil line which can follow the movement of the supporting piston is produced in an effective and robust manner. Oil can hence be supplied to the radial bearings regardless of the position of the supporting piston in the vertical direction.

Preferably, the first tube part is fixedly connected to the supporting plate comprised in the supporting piston, and the second tube part is fixedly connected to the frame.

The gyratory crusher is preferably provided with a measuring device, which enables measurement of the position of the first tube part in relation to the second tube part, for measuring the position of the first crushing shell in the vertical direction in relation to the position of the second crushing shell in the vertical direction. A reliable measurement of the width of the crushing gap can thus be obtained.

Preferably, the measuring device is constituted by an inductive sensor. One advantage with such a sensor is that it is very vibration-proof.

The measuring device preferably extends through the second tube part and detects the position of the first tube part.

The oil line preferably comprises a sensor tube fixedly arranged in the first tube, which sensor tube at least partially encloses the measuring device. A very robust and reliable measurement of the vertical position of the supporting piston can thus be obtained.

The sensor tube can be provided with at least one projecting spacer arm, which holds the measuring device received in the sensor tube centrally placed in the upper tube part.

The measuring device can alternatively be arranged in a double-walled sensor tube, which sensor tube at least partially encloses the measuring device.

In an alternative embodiment, the oil line is constituted by a lubricating oil tube, which is fixedly arranged in the frame and around which the supporting plate comprised in the supporting piston is slidably arranged.

Further advantages and characteristics of the invention will become apparent from the description below and the enclosed claims.

In one aspect of the invention, there is provided a gyratory crusher comprising a crushing head arranged rotatably about a substantially vertical shaft and on which a first crushing shell is mounted, a frame, on which a second crushing shell is mounted, which second crushing shell, together with the first crushing shell, delimits a crushing gap, a supporting piston arranged inside a cavity of the shaft and which supports the crushing head and is displaceable in a vertical direction to adjust a width of the crushing gap, an eccentric, which by means of at least one radial bearing, is arranged rotatably about the shaft, a driving device arranged to rotate the eccentric to cause the crushing head, which is arranged rotatably on the eccentric, to execute a gyratory pendulum movement for crushing of material introduced into the crushing gap, and an oil line, arranged in the cavity and extending through a piston plate included in the supporting piston, for supplying lubricating oil to a lubricating oil chamber, the lubricating oil chamber configured at least partially in the cavity above the piston plate, the lubricating oil chamber being connected to the radial bearing by a duct arranged in the shaft.

In another aspect of the invention, there is provided a gyratory crusher comprising a crushing head arranged rotatably about a vertical shaft and on which a first crushing shell is mounted, a frame, on which a second crushing shell is mounted, said second crushing shell and said first crushing shell delimiting a crushing gap, a supporting piston arranged inside a cavity of said shaft for supporting the crushing head, said supporting piston displaceable in a vertical direction for adjusting a width of the crushing gap, an eccentric, which by means of at least one radial bearing, arranged rotatably about the shaft, a driving device for rotating said eccentric to cause the crushing head to execute a gyratory pendulum movement for crushing of material introduced into the crushing gap, and an oil line, arranged in the cavity and extending through a piston plate, for supplying lubricating oil to a lubricating oil chamber, said lubricating oil chamber configured at least partially in said cavity above the piston plate, the lubricating oil chamber being connected to said radial bearing by a duct arranged in the shaft.

BRIEF DESCRIPTION OF THE DRAWINGS

The invention will be described below with the aid of illustrative embodiments and with reference to the appended drawings.

DETAILED DESCRIPTION OF THE PREFERRED EMBODIMENTS

Figure 1A:
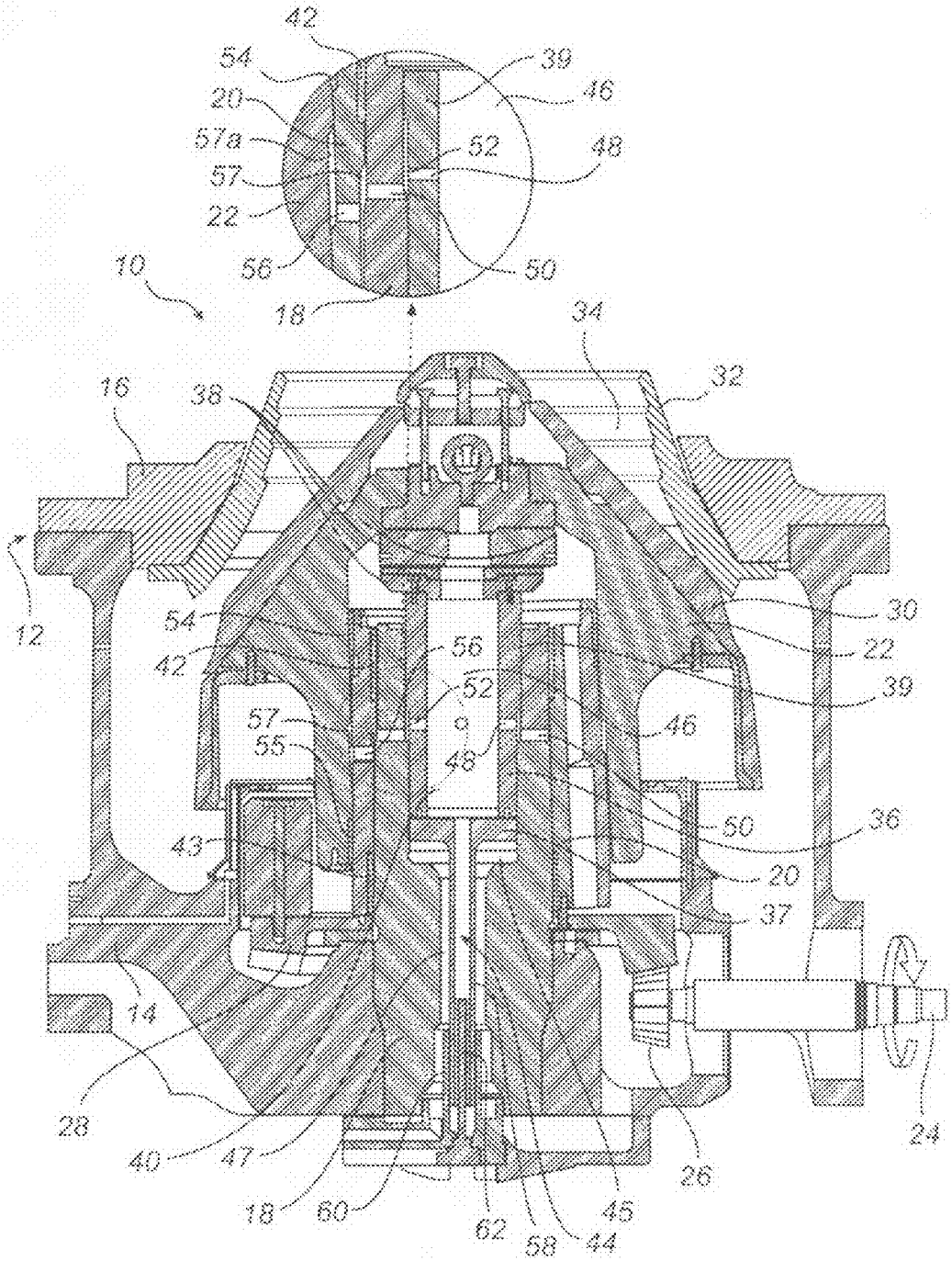
FIG. 1*a* is a schematic sectional view and shows a gyratory crusher according to a first embodiment.

FIG. 1*a* shows in schematic representation a gyratory crusher 10, which has a frame 12 comprising a frame bottom part 14 and a frame top part 16. A vertical center shaft 18 is fixedly connected to the frame bottom part 14 of the frame 12. Arranged rotatably about the center shaft 18 is an eccentric 20. A crushing head 22 is mounted rotatably about the eccentric 20, and hence about the center shaft 18. A drive shaft 24 is arranged to cause the eccentric 20, by means of a conical gear 26 in engagement with a gear rim 28 connected to the eccentric 20, to rotate about the center shaft 18. The outer periphery of the eccentric 20 inclines somewhat in relation to the vertical plane, as can be seen in FIG. 1*a* and as is previously known, per se. The inclination of the outer periphery of the eccentric 20 means that the crushing head 22, too, will incline somewhat in relation to the vertical plane.

A first crushing shell 30 is fixedly mounted on the crushing head 22. A second crushing shell 32 is fixedly mounted on the frame top part 16. Between the two crushing shells 30, 32 is formed a crushing gap 34, which in axial section, as is shown in FIG. 1*a*, has a width which diminishes in the downward direction. When the drive shaft 24, during operation of the crusher 10, rotates the eccentric 20, the crushing head 22 will have a gyrating movement. Material which is to be crushed is introduced into the crushing gap 34 and is crushed between the first crushing shell 30 and the second crushing shell 32 as a result of the gyrating movement of the crushing head 22, during which the two crushing shells 30, 32 alternately move closer together and farther apart, viewed at an optional point on the second crushing shell 32. Moreover, the crushing head 22, and the first crushing shell 30 mounted thereon, will roll, via the material to be crushed, against the second crushing shell 32. The rolling causes the crushing head 22 to slowly rotate relative to the frame 12 with a rotational direction which essentially is opposed to the rotational direction of the eccentric 20.

The crushing head 22 rests on a supporting piston 36 arranged inside a cavity 40 in the shaft 18. The supporting piston 36, which has a supporting plate 37 and a supporting sleeve 39 arranged above this, can be raised and lowered hydraulically in the cavity 40 by regulation of the quantity of oil in a high-pressure oil chamber 45 configured in the cavity 40 below the supporting plate 37. The supporting piston 36 can be rotation-locked to the center shaft 18. The purpose of the facility to raise and lower the supporting piston 36, and thus raise and lower the crushing head 22 with the first crushing shell 30 mounted thereon, is inter alia to be able to compensate for wear and tear on the crushing shells 30, 32, but also to allow the width of the gap 34 to be varied with a view to achieving different sizes of the crushed material.

The crushing head 22 rests on a set of axial bearings 38, which are arranged between the crushing head 22 and the supporting piston 36 and which are supported by the supporting piston 36. The axial bearings 38 enable inclination of the crushing head 22 during its gyrating movement.

Between the eccentric 20 and the shaft 18 is a set of radial bearings, in the form of an upper bearing bush 42 and a lower bearing bush 43, arranged with a view to absorbing loads which are generated during the crushing. The bearing bushes 42, 43 are usually made of a bearing material, for example bronze. The two bearing bushes 42, 43 are received in an upper and a lower recess in the eccentric 20.

The gyratory crusher 10 is further provided with a lubricating oil line 44 for the supply of lubricating oil from a lubricating oil tank (not shown) to a lubricating oil chamber 46 configured in the cavity 40 above the supporting plate 37. The supporting piston 36 is displaceable in the vertical direction by regulation of the quantity of oil in the high-pressure oil chamber 45 below the supporting plate 37. Between the supporting plate 37 of the supporting piston 36 and the inner limit surface of the shaft 18 there is a sealing device (not shown), which prevents high-pressure oil from leaking from the high-pressure oil chamber 45 to the lubricating oil chamber 46. High-pressure oil can be supplied to the chamber 45 via a high-pressure oil line 47 arranged outside the lubricating oil line 44. The oil in the high-pressure oil chamber 45 has typically, during operation of the crusher 10, an absolute pressure of about 60-130 bar. By displacement of the supporting piston 36 in the vertical direction, which is achieved by high-pressure oil being led to or from the high-pressure oil chamber 45, the desired width of the crushing gap 34 can be set. During adjustment of the crushing gap 34, the supporting piston 36 hence moves in the vertical direction. The lubricating oil line 44, which extends through the supporting piston 36, is tailored to be able to follow the movement of the supporting piston 36 in the vertical direction. The oil line 44, which is illustrated in an enlarged view in FIG. 1*b*, includes in this embodiment a telescopic tube having two tube parts 58, 60, which can be axially displaced in relation to each other. The outer diameter of the upper tube part 58 is somewhat smaller than the inner diameter of the lower tube part 60 in order to enable telescopic movement between the two tube parts 58, 60. A sealing ring 59 has been arranged in a groove at the lower end of the upper tube 58.

As can best be seen from the enlarged portion in FIG. 1*a*, the supporting sleeve 39 and the shaft 18 are each provided with a number of ducts 48 and 50, through which lubricating oil can be led from the lubricating oil chamber 46 to the bearing bushes 42 and 43 arranged between the eccentric 20 and the shaft 18. The supporting sleeve 39 is provided on its outer side with a circumferential groove 52 in connection to the outlet of the ducts 48 configured in the supporting sleeve 39. The circumferential groove 52 ensures that the necessary quantity of lubricating oil can be led from the lubricating oil chamber 46 to the bearing bushes 42, 43, regardless of the vertical position of the supporting piston 36. This lubricating oil is hence led to the bearing bushes 42 and 43 from the lubricating oil chamber 46 via the ducts 48 and 50, as well as the groove 52.

The crusher 10 is further provided with a second set of radial bearings, in the form of bearing bushes 54 and 55, which are arranged between the eccentric 20 and the crushing head 22 with a view to absorbing radial loads during operation of the crusher 10. With a view to enabling a supply of lubricating oil to the bearing bushes 54, 55 from the lubricating oil chamber 46, the eccentric 20 has been provided with a number of ducts 56. During operation of the crusher 10, the eccentric 20 is rotated, while the shaft 18 is fixed, and thus the eccentric 20, and hence also the ducts 56 configured in the eccentric 20, move relative to the ducts 50 configured in the shaft 18. With a view to ensuring that a sufficient quantity of lubricating oil is led to the bearing bushes 54 and 55, the shaft 18 has been provided on its outer side with a circumferential groove 57 in connection to the outlet of the ducts 50 arranged in the shaft 18. The circumferential groove 57 in connection to the outlet of the ducts 50 arranged in the shaft 18 enables a continuous supply of lubricating oil to the bearing bushes 54 and 55. This lubricating oil is hence led to the bearing bushes 54 and 55 from the lubricating oil chamber 46 via the ducts 48, 50 and 56, as well as the grooves 52 and 57. As can be seen from the enlarged portion of FIG. 1*a*, a further circumferential groove 57*a* can be arranged on the outer side of the eccentric 20 and/or on the inner limit surface of the crushing head 22, with a view to further improving the chance of the lubricating oil leaving the ducts 56 to quickly reach the bearing bushes 54, 55, regardless of the present mutual rotational and height position of the crushing head 22 and the eccentric 20.

Figure 1B:
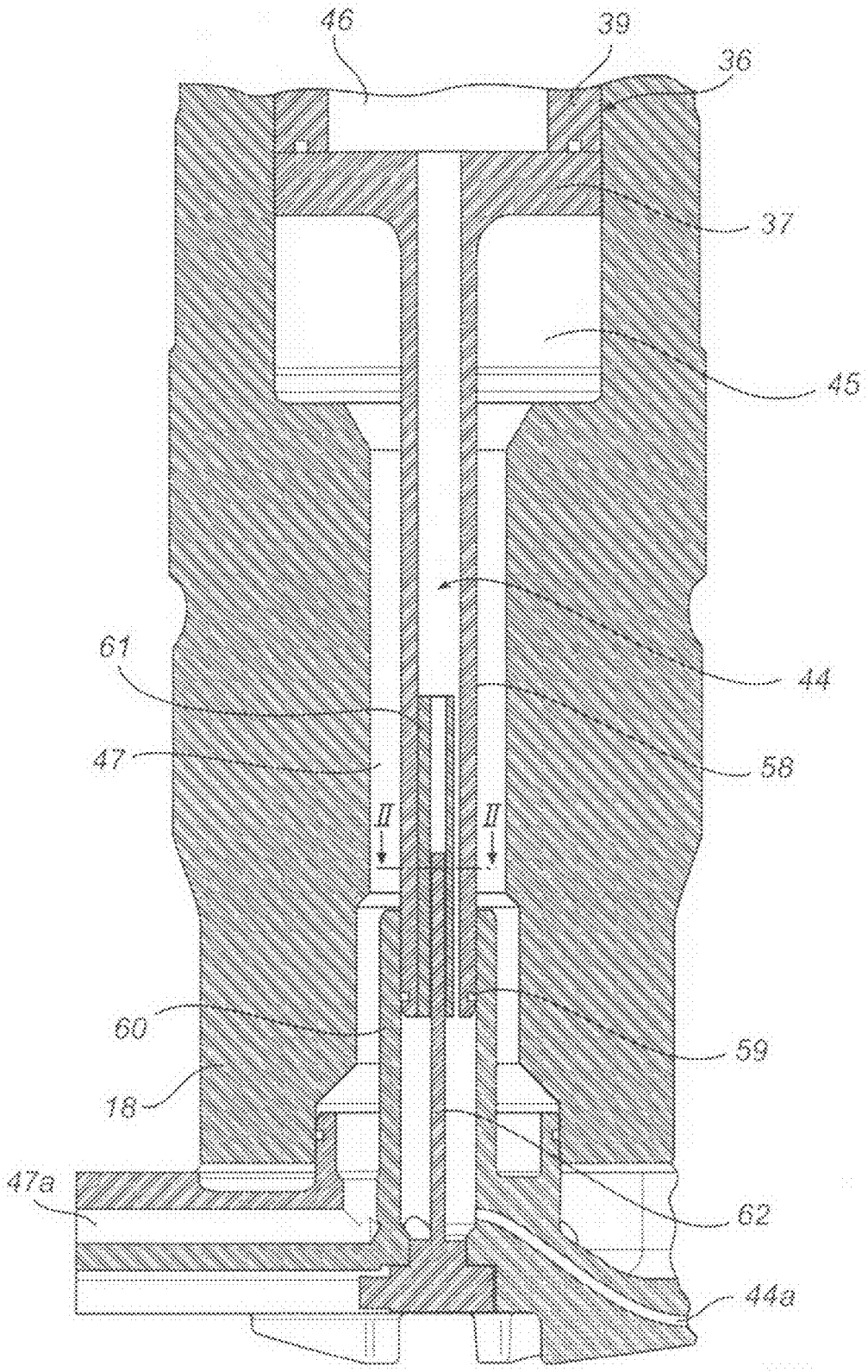
FIG. 1*b* is a schematic sectional view and shows the lower portion of the gyratory crusher shown in FIG. 1*a*.

As can best be seen from FIG. 1*b*, the upper tube part 58 of the telescopically configured lubricating oil line 44 is fixedly connected to the supporting plate 37, and its lower tube part 60 is fixedly connected to the frame 12. The upper tube part 58 is slidably arranged relative to the lower tube part 60. By virtue of its telescopic function, the lubricating oil line 44 is hence tailored to be able to follow the movement of the supporting piston 36 in the vertical direction during setting of the width of the crushing gap 34. The lubricating oil line 44 is connected to a lubricating oil tank (not shown), from which lubricating oil can be supplied to the lubricating oil chamber 46 by means of a pump (not shown). As has been stated above, the lubricating oil chamber 46 is connected to the bearing bushes 42 and 43 by the ducts 48 and 50 in the supporting sleeve 39 and the shaft 18. Lubricating oil which is supplied to the lubricating oil chamber 46 via the oil line 44 can thus be led onward to the bearing bushes 42 and 43. The fact that the oil supplied in the lubricating oil chamber 46 has a certain pressure means that oil will be led to the upper bearing bush 42 and to the lower bearing bush 43. The oil in the lubricating oil chamber 46 typically has a pressure of about 1-10 bar excess pressure. The ducts 56 arranged in the eccentric 20 enable lubricating oil, as has been described above, to be led also to the bearing bushes 54 and 55 arranged between the eccentric 20 and the crushing head 22.

As can best be seen from FIG. 1*b*, the lubricating oil line 44 accommodates a measuring device, in the form of an inductive sensor 62, which detects the position of the upper tube part 58, in the vertical direction, relative to the position of the lower tube part 60 in the vertical direction. It is thus possible to determine the width of the crushing gap 34, since the upper tube part 58 is fixedly connected to the supporting piston 36 supporting the crushing head 22. The inductive sensor 62 can be coupled to a control member, which, based on measurement data from the sensor 62, can automatically adjust the crushing gap 34 to the desired width.

As can be seen from FIG. 1*b*, high-pressure oil can hence be led to the high-pressure oil line 47 via a high-pressure oil inlet 47*a* arranged in the lower portion of the crusher, while lubricating oil can be led to the lubricating oil line 44 via a lubricating oil inlet 44*a* arranged in the lower portion of the crusher. High-pressure oil and lubricating oil, which have different pressures and which can also otherwise have different properties, can thus be supplied individually, and separate from each other, to the respective part of the cavity 40 which is divided by the supporting plate 37 into the high-pressure oil chamber 45 and the lubricating oil chamber 46.

The lower end of the inductive sensor 62 is fixedly connected to the frame 12. The inductive sensor 62 is enclosed by a sensor tube 61, which is fixed inside the upper tube part 58. The inductive sensor 62 can detect the position of the sensor tube 61 in the vertical direction, and the position of the upper tube part 58 in the vertical direction can thus be determined.

Figure 2:
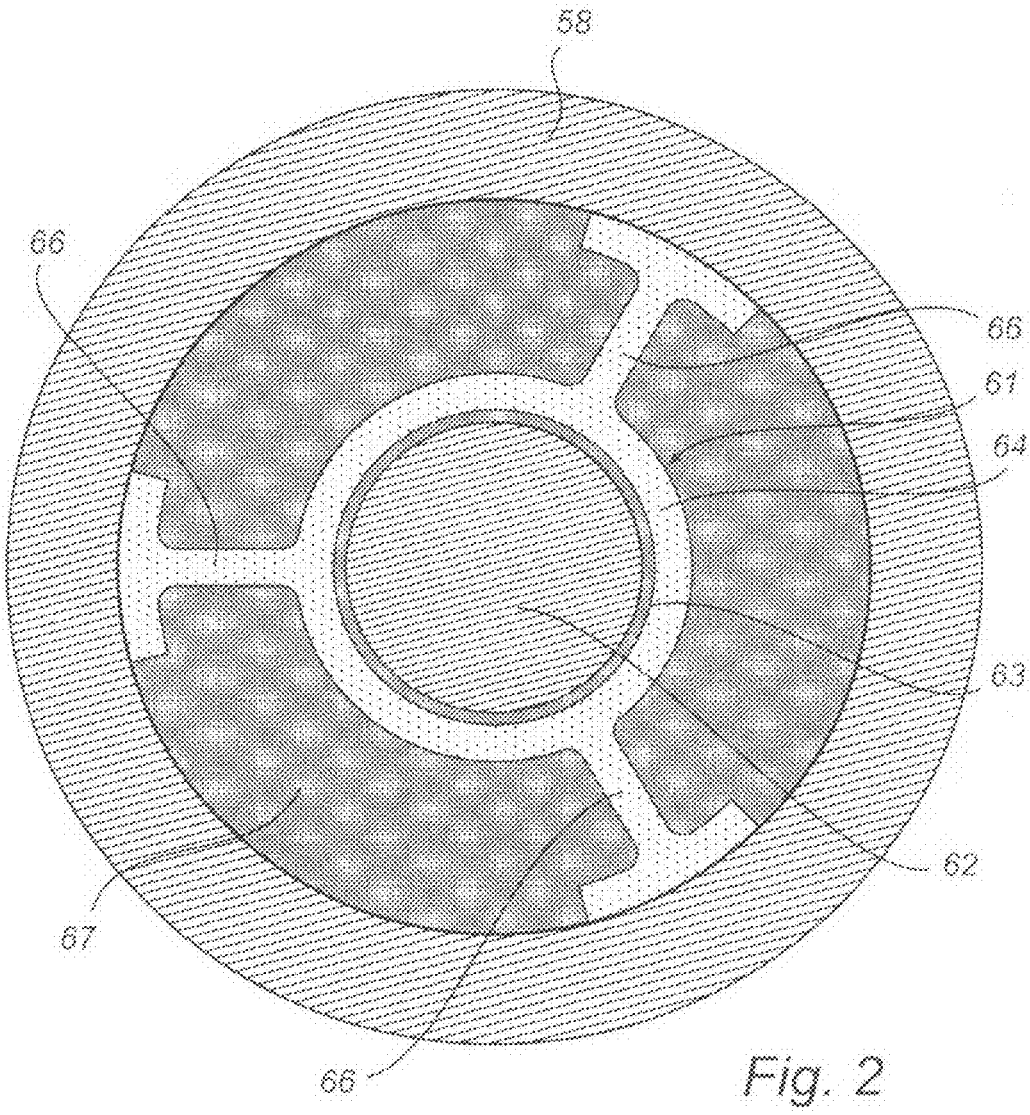
FIG. 2 shows the section II-II marked in FIG. 1*b*.

FIG. 2 shows the section II-II shown in FIG. 1*b*, i.e., a cross section of the upper tube part 58, the sensor tube 61 and the inductive sensor 62 viewed from above. The sensor tube 61 includes in this embodiment of a central tube 64 and three T-shaped spacer arms 66. Between the central tube 64 and the inductive sensor 62 there is a narrow gap 63. Preferably, the central tube 64 is configured such that an approximate 1 mm wide circumferential groove 63 is formed between the inductive sensor 62 and the central tube 64. As a result of the "tight" fit between the sensor 62 and the central tube 64, a very robust and reliable measurement of the position of the upper tube part 58 in the vertical direction is obtained. For example, an inductive sensor of the EDS type from Micro Epsilon, Ortenburg, Germany, can be used as the sensor 62.

The spacer arms 66 are fixed against the inner limit surface of the upper tube part 58 and thus hold the tube 64 centrally placed in the lubricating oil line 44. The spacer arms 66 also help to form a chamber 67 arranged between the central tube 64 and the inner limit surface of the upper tube part 58, which chamber constitutes a part of the lubricating oil line 44. This means that the lubricating oil can easily, in the chamber 67, i.e., between the central tube 64 and the inner limit surface of the upper tube part 58, pass the sensor 62 on its way through the lubricating oil line 44.

Figure 3:
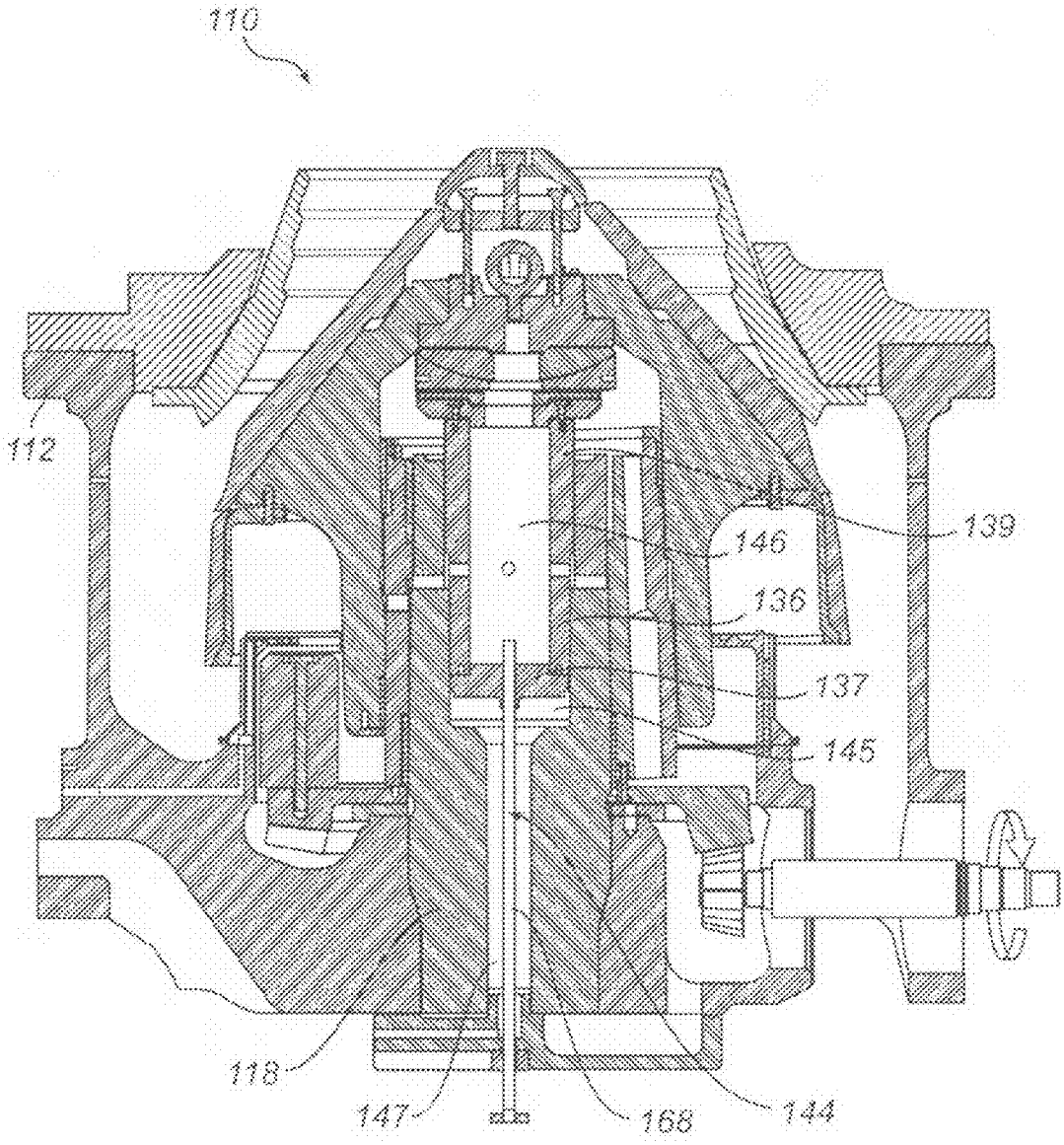
FIG. 3 is a schematic sectional view and shows a gyratory crusher according to an alternative embodiment.

FIG. 3 illustrates schematically a gyratory crusher 110 according to an alternative embodiment in which elements from the embodiment shown in FIG. 1*a* have been combined with new elements. Reference symbols in FIG. 3 hence allude to elements which resemble or are identical with elements found in the previously described embodiment.

Instead of a telescopic tube, the crusher 110 includes in this embodiment a lubricating oil line 144 in the form of a lubricating oil tube 168 which is fixedly connected to the frame 112 and around which the supporting plate 137 of the supporting piston 136 is slidably arranged. The lubricating oil tube 168 hence leads lubricating oil from a storage (not shown) of lubricating oil to a lubricating oil chamber 146 arranged above the supporting plate 137, via an opening in the center of the supporting plate 137.

During setting of the width of the crushing gap, the supporting piston 136, with therein included supporting plate 137 and supporting sleeve 139, moves vertically relative to the lubricating oil tube 168, since the lubricating oil tube 168 is fixedly connected to the frame 112. Between the supporting plate 137 and the inner limit surface of the shaft 118, as well as between the lubricating oil tube 168 and the supporting plate 137, there are sealing devices to prevent leakage of pressurized oil from the high-pressure oil chamber 145 to the lubricating oil chamber 146.

The lubricating oil tube 168 hence extends through the supporting plate 137 and up into the lubricating oil chamber 146. The lubricating oil tube 168 extends sufficiently far up into the lubricating oil chamber 146 that the outlet of the lubricating oil tube 168 is always situated above the supporting plate 137. Lubricating oil can hence be supplied to the lubricating oil chamber 146, via the lubricating oil tube 168, from an oil reservoir (not shown), regardless of the present position of the supporting piston 136 in the vertical direction. High-pressure oil can be supplied to the sub-chamber 145 via a high-pressure oil line 147 arranged outside the tube 168.

It has been described above that the supporting piston 36 is provided with a circumferential groove 52 to enable a sufficient quantity of oil to be supplied to the bearing bushes 42, 43. In an alternative embodiment, the size of the ducts 48 configured in the supporting piston 36 is tailored to enable oil to be led onward through the shaft 18, regardless of the vertical position of the supporting piston 36. These ducts can hence be oval, or rectangular, and/or have a different shape which means that lubricating oil can be led to the bearing bushes, regardless of the vertical position of the supporting piston 36.

In the first-described embodiment, the sensor is arranged in a sensor tube having projecting spacer arms. In an alternative embodiment, the sensor tube 61 has no projecting arms, but instead includes only of a tube 64, which is anchored to a portion of the inner limit surface of the upper tube part 58. The sensor tube is hence in this embodiment not situated centrally in the upper tube part, but sits fixedly arranged, for example by welding, on the inner wall of the upper tube.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A gyratory crusher, comprising:

a crushing head arranged rotatably about a substantially vertical shaft and on which a first crushing shell is mounted;

a frame, on which a second crushing shell is mounted, which second crushing shell, together with the first crushing shell, delimits a crushing gap;

a supporting piston arranged inside a cavity of said shaft and which supports the crushing head and is displaceable in a vertical direction to adjust a width of the crushing gap;

an eccentric, which by means of at least one radial bearing, is arranged rotatably about the shaft;

a driving device arranged to rotate said eccentric to cause the crushing head, which is arranged rotatably on the eccentric, to execute a gyratory pendulum movement for crushing of material introduced into the crushing gap; and an oil line, arranged in the cavity and extending through a piston plate included in the supporting piston, for supplying lubricating oil to a lubricating oil chamber, said lubricating oil chamber configured at least partially in said cavity above the piston plate, the lubricating oil chamber being connected to one or more of the at least one radial bearings by a duct arranged in the shaft.

2. The gyratory crusher as claimed in claim 1, wherein the width of the crushing gap is adjustable by regulation of the quantity of oil in a high-pressure oil chamber configured at least partially in said cavity below the piston plate.

3. The gyratory crusher as claimed in claim 1, wherein the oil line accommodates a measuring device for measuring the position of the first crushing shell in the vertical direction in relation to the position of the second crushing shell in the vertical direction.

4. The gyratory crusher as claimed in claim 1, wherein said oil line includes a telescoping tube having a first tube part and a second tube part.

5. The gyratory crusher as claimed in claim 4, wherein the first tube part is fixedly connected to the supporting plate included in the supporting piston, and the second tube part is fixedly connected to the frame.

6. The gyratory crusher as claimed in claim 4, further comprising a measuring device, for measuring the position of the first tube part in relation to the second tube part for determining the position of the first crushing shell in the vertical direction in relation to the position of the second crushing shell in the vertical direction.

7. The gyratory crusher as claimed in claim 6, in which the measuring device comprises an inductive sensor.

8. The gyratory crusher as claimed in claim 7, wherein the measuring device is arranged in a double-walled sensor tube, which sensor tube at least partially encloses the measuring device.

9. The gyratory crusher as claimed in claim 6, wherein the measuring device extends through the second tube part and detects the position of the first tube part.

10. The gyratory crusher as claimed in claim 6, wherein the oil line includes a sensor tube fixedly arranged in the first tube, which sensor tube at least partially encloses the measuring device.

11. The gyratory crusher as claimed in claim 10, wherein said sensor tube is provided with at least one projecting spacer arm.

12. The gyratory crusher as claimed in claim 1, wherein the oil line is a lubricating oil tube, which is fixedly arranged in the frame and around which the supporting plate included in the supporting piston is slidably arranged.

13. A gyratory crusher, comprising:

a crushing head arranged rotatably about a vertical shaft and on which a first crushing shell is mounted;

a frame, on which a second crushing shell is mounted, said second crushing shell and said first crushing shell delimiting a crushing gap;

a supporting piston arranged inside a cavity of said shaft for supporting the crushing head, said supporting piston displaceable in a vertical direction for adjusting a width of the crushing gap;

an eccentric, which by means of at least one radial bearing, arranged rotatably about the shaft;

a driving device for rotating said eccentric to cause the crushing head to execute a gyratory pendulum movement for crushing of material introduced into the crushing gap; and an oil line, arranged in the cavity and extending through a piston plate, for supplying lubricating oil to a lubricating oil chamber, said lubricating oil chamber configured at least partially in said cavity above the piston plate, the lubricating oil chamber being connected to one or more of the at least one radial bearings by a duct arranged in the shaft.

14. The gyratory crusher as claimed in claim 13, wherein said oil line includes a telescoping tube having a first tube part and a second tube part.

15. A gyratory crusher, comprising:

a crushing head arranged rotatably about a substantially vertical shaft and on which a first crushing shell is mounted;

a frame, on which a second crushing shell is mounted, which second crushing shell, together with the first crushing shell, delimits a crushing gap;

a supporting piston arranged inside a cavity of said shaft and which supports the crushing head and is displaceable in a vertical direction to adjust a width of the crushing gap;

an eccentric, which by means of at least one radial bearing, is arranged rotatably about the shaft;

a driving device arranged to rotate said eccentric to cause the crushing head, which is arranged rotatably on the eccentric, to execute a gyratory pendulum movement for crushing of material introduced into the crushing gap; and an oil line, arranged in the cavity and extending through a piston plate included in the supporting piston, for supplying lubricating oil to a lubricating oil chamber, said lubricating oil chamber configured at least partially in said cavity above the piston plate, the lubricating oil chamber being connected to one or more of the at least one radial bearings by a duct arranged in the shaft, wherein said oil line includes a telescoping tube having a first tube part and a second tube part.

16. The gyratory crusher as claimed in claim 15, wherein the first tube part is fixedly connected to the supporting plate included in the supporting piston, and the second tube part is fixedly connected to the frame.

17. The gyratory crusher as claimed in claim 15, further comprising a measuring device, for measuring the position of the first tube part in relation to the second tube part for determining the position of the first crushing shell in the vertical direction in relation to the position of the second crushing shell in the vertical direction.

18. The gyratory crusher as claimed in claim 17, in which the measuring device comprises an inductive sensor.

19. The gyratory crusher as claimed in claim 17, wherein the measuring device extends through the second tube part and detects the position of the first tube part.

20. The gyratory crusher as claimed in claim 17, wherein the oil line includes a sensor tube fixedly arranged in the first tube, which sensor tube at least partially encloses the measuring device.

21. The gyratory crusher as claimed in claim 20, wherein said sensor tube is provided with at least one projecting spacer arm.

22. The gyratory crusher as claimed in claim 18, wherein the measuring device is arranged in a double-walled sensor tube, which sensor tube at least partially encloses the measuring device.

23. The gyratory crusher as claimed in claim 15, wherein the width of the crushing gap is adjustable by regulation of the quantity of oil in a high-pressure oil chamber configured at least partially in said cavity below the piston plate.

24. The gyratory crusher as claimed in claim 15, wherein the oil line accommodates a measuring device for measuring the position of the first crushing shell in the vertical direction in relation to the position of the second crushing shell in the vertical direction.

25. The gyratory crusher as claimed in claim 15, wherein the oil line is a lubricating oil tube, which is fixedly arranged in the frame and around which the supporting plate included in the supporting piston is slidably arranged.

* * * * *